US009394779B2

(12) United States Patent
Nelson

(10) Patent No.: US 9,394,779 B2
(45) **Date of Patent: *Jul. 19, 2016**

(54) HYDRAULIC FRACTURING ISOLATION METHODS AND WELL CASING PLUGS FOR RE-FRACTURING HORIZONTAL MULTIZONE WELLBORES

(71) Applicant: BAKER HUGHES INCORPORATED, Houston, TX (US)

(72) Inventor: Scott G. Nelson, Cypress, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/323,804

(22) Filed: Jul. 3, 2014

(65) Prior Publication Data

US 2016/0003021 A1 Jan. 7, 2016

(51) Int. Cl.
*E21B 43/267* (2006.01)
*E21B 43/14* (2006.01)
*E21B 33/124* (2006.01)

(52) U.S. Cl.
CPC ..... *E21B 43/267* (2013.01); *E21B 33/124* (2013.01); *E21B 43/14* (2013.01)

(58) Field of Classification Search
CPC ..... E21B 43/267; E21B 43/14; E21B 33/124; E21B 43/261
See application file for complete search history.

(56) References Cited

U.S. PATENT DOCUMENTS 4,439,328 A * 3/1984 Moity ..... C09K 8/035 507/103
6,446,727 B1 * 9/2002 Zemlak et al. ..... 166/308.1
7,478,676 B2 * 1/2009 East, Jr. ..... E21B 33/1208 166/191
7,735,556 B2 6/2010 Misselbrook et al.
7,870,902 B2 1/2011 Misselbrook et al.
2006/0283592 A1 12/2006 Sierra et al.
2007/0284109 A1 * 12/2007 East ..... E21B 33/1208 166/305.1
2010/0212906 A1 8/2010 Fulton et al.
2012/0073812 A1 * 3/2012 Cochran ..... E21B 33/1208 166/283
2012/0292031 A1 * 11/2012 Nelson ..... E21B 43/267 166/308.1
2013/0186625 A1 * 7/2013 O'Malley ..... 166/281

OTHER PUBLICATIONS

Liu, Mingzhu and Cheng, Rongshi, Preparation and Swelling Properties of Super-Absorbent Polymer, 14 Chinese Journal of Polymer Science 1 (1996), p. 48.*
BJ Services Company, LitePlug Isolation System, Reliable, low-risk multizone isolation, dated Nov. 2009, 2 pages.
BJ Services Company, News Release, BJ Services Celebrates 300th Field Application of LitePlug Zone Isolation System in Canada, Consolidated Sand Plug Technology Speeds Horizontal Multizone Fracturing, dated Mar. 11, 2009, 2 pages.
Nelson, Scott, BJ Services Company, LitePlug technology saves damaged wells, BJ Techline, non-dated, p. 7.

* cited by examiner

*Primary Examiner* — Zakiya W Bates
*Assistant Examiner* — Crystal J Miller
(74) *Attorney, Agent, or Firm* — Parsons Behle & Latimer

(57) ABSTRACT

A method for hydraulically isolating a portion of a multizone wellbore by providing a plug proximate the portion of the wellbore. The plug may be a proppant combined with a polymer. The proppant may be an ultra-lightweight proppant and the polymer may be cross-linked. The polymer may be a superabsorbent polymer or a hydrophobically modified polysaccharide. The plug may be formed by placing a pill of proppant and polymer within the wellbore and slowing pumping fluid down to cause the pill to bridge off and form a plug. The pill may also include a lightweight filler. The plug may be used to hydraulically isolate a portion of the wellbore during a fracturing or re-fracturing process. Multiple plugs may be placed along the wellbore to hydraulically isolate portions of the wellbore during the fracturing or re-fracturing process.

13 Claims, 12 Drawing Sheets

FIG. 9

HYDRAULIC FRACTURING ISOLATION METHODS AND WELL CASING PLUGS FOR RE-FRACTURING HORIZONTAL MULTIZONE WELLBORES

BACKGROUND

1.Field of the Disclosure

The embodiments described herein relate to a method and system to enable the re-stimulation through means of hydraulic fracturing of horizontal multizone wellbores. The method and system uses wellbore plugs that may be comprised of various combinations of proppants, and ultra-lightweight proppants, and lightweight fillers, and polymers. The plugs may be used to hydraulically isolate portions of a wellbore during the re-fracturing treatment process.

2. Description of the Related Art

Natural resources such as gas and oil may be recovered from subterranean formations using well-known techniques. For example, a horizontal wellbore may be drilled within the subterranean formation. After formation of the horizontal wellbore, a string of pipe, e.g., casing, may be run or cemented into the wellbore. Hydrocarbons may then be produced from the horizontal wellbore.

In an attempt to increase the production of hydrocarbons from the wellbore, the casing is perforated and fracturing fluid is pumped into the wellbore to fracture the subterranean formation. The fracturing fluid is pumped into the wellbore at a rate and a pressure sufficient to form fractures that extend into the subterranean formation, providing additional pathways through which reservoir fluids being produced can flow into the wellbores. The fracturing fluid typically includes particulate matter known as a proppant, e.g., graded sand, ceramic proppant, bauxite proppant, or resin coated sand, that may be suspended in the fracturing fluid. The proppant pumped into the fractures serves to form a permeable pack that "props" the fractures open after the pressure exerted on the fracturing fluid during the hydraulic fracturing process has ended and the fractures close onto the proppant.

A production zone within a wellbore may have been previously fractured, but the prior hydraulic fracturing treatment may not have adequately stimulated the formation leading to insufficient production results. Even if the formation was adequately fractured, the production zone may no longer be producing at desired levels. Over an extended period of time, the production from a previously fractured horizontal multizone wellbore may decrease below a minimum threshold level. Techniques used to increase the hydrocarbon production from an existing wellbore include the re-fracturing of the existing casing perforations, and the addition of new perforations in the casing from which new fractures into the subterranean formation can be propagated. Of concern is the problem faced due to the multiple open fractures that already exist within the horizontal wellbore from previous hydraulic fracturing stimulation treatments. The ability to isolate the targeted casing perforations ensures that the fracturing fluid pumped into the wellbore enters the formation at its intended point within the horizontal lateral. To accomplish this, the re-fracturing treatment of a horizontal wellbore is designed to be pumped down a string of coiled tubing, or a string of smaller jointed pipe known as tubing. The temporary setting of an isolation tool known as a packer near the end of the tubular pipe then isolates all of the open perforations along the annulus between the wellbore casing and the smaller diameter coiled tubing, or tubing string. Expandable tubulars or cladding procedures have been used within a wellbore in an attempt to block the flow path of the fracturing fluid into old fractures, so as to promote the formation of new fracture clusters. The use of expandable tubulars or cladding may not adequately provide the desired results and further, may incur too much expense in the effort to increase production from the wellbore. A more efficient way to increase the production of a horizontal wellbore is needed.

SUMMARY

The present disclosure is directed to a method and system for use in horizontal multizone refracturing operations using a plug comprised of proppant and ultra-lightweight proppant and lightweight filler material and polymers, or combinations of these materials, to selectively isolate a portion of a wellbore that substantially overcomes some of the problems and disadvantages discussed above.

One embodiment is a method for re-fracturing a location of a formation of a multizone horizontal wellbore comprising hydraulically isolating a first location from a portion of the multizone horizontal wellbore uphole from the first location, the first location having been previously hydraulically fractured at least once. The method includes hydraulically re-fracturing the first location and providing a first plug proximate to the first location after the first location has been hydraulically re-fractured. The method includes pumping fluid down the wellbore to bridge off the first plug to hydraulically isolate the re-fractured first location from the multizone horizontal wellbore uphole of the first location. The method includes hydraulically isolating a second location from a portion of the multizone horizontal wellbore uphole of the second location, hydraulically fracturing the second location and providing a second plug proximate to the second location after the second location has been fractured. The method includes pumping fluid down the wellbore to bridge off the second plug to hydraulically isolate the second location from a portion of the multizone horizontal wellbore uphole of the second location.

The second location of the method may have been previously hydraulically fractured at least once and wherein hydraulically fracturing the second location further comprises hydraulically re-fracturing the second location. The first plug may comprise proppant combined with a polymer and the second plug may comprise proppant combined with a polymer. The proppant may be an ultra-lightweight proppant. The polymer may be cross-linked. The polymer may be a superabsorbent polymer. The polymer may be a hydrophobically modified polysaccharide. The plugs may comprise a lightweight filler combined with ultra-lightweight proppant and polymer. The first location may be a fracture cluster farthest downhole of the multizone horizontal wellbore and hydraulically isolating the first location may comprise creating a seal with a packing element connected to a coiled tubing string to seal an annulus between the coiled tubing string and a casing of the multizone horizontal wellbore uphole of the first location.

The method may include cleaning out at least a portion of the multizone horizontal wellbore after re-fracturing the first location and fracturing the second location to remove the first and second plugs from the multizone horizontal wellbore. The method may include producing hydrocarbons from the first and second locations of the multizone horizontal wellbore. The wellbore may include at least one fracture cluster positioned between the first location and the second location. The method may include providing a third plug comprised of proppant combined with polymer between the first and second locations and creating a seal with a packing element connected to a coiled tubing string to seal an annulus between the coiled tubing string and a casing of the wellbore uphole from the second location. The third plug may be provided prior to creating a seal uphole from the second location and may comprising pumping fluid down the wellbore to bridge off the third plug prior to creating the seal uphole from the second location.

One embodiment is a system for re-fracturing a plurality of locations within a multizone horizontal wellbore comprising a first tubing string positioned within a multizone horizontal wellbore, the first tubing string extending from a surface location to a first location in the multizone horizontal wellbore, the first location being a lowermost previously fractured location along the wellbore. The system includes a packing element connected proximate to an end of the first tubing string, the packing element adapted to repeatedly seal an annulus between the first tubing string and a casing of the multizone horizontal wellbore, the end of the first tubing string being adapted to permit the hydraulic re-fracturing of selected locations within the multizone horizontal wellbore. The system includes a plurality of plugs comprised of proppant and polymer, each of the plurality of plugs positioned proximate to a previously fractured location to selectively hydraulically isolate the previously fractured location.

The tubing string of the system may be a coiled tubing string. The proppant may be ultra-lightweight proppant. The polymer may be a hydrophobically modified polysaccharide. The polymer may be a superabsorbent polymer. The plugs may include a lightweight filler combined with ultra-lightweight proppant and polymer.

One embodiment is a method for selectively fracturing one or more locations within a horizontal wellbore comprising positioning a packing element connected to a tubing string uphole of a first location and actuating the packing element to seal an annulus between the tubing string and a casing uphole of the first location. The method includes pumping fluid down the tubing string to fracture the first location and providing a first plug comprised of proppant and polymer proximate the first location. The method includes pumping fluid down the horizontal wellbore to bridge off the first plug to hydraulically isolate the first location and unsetting the packing element. The method includes positioning the packing element uphole of a second location and actuating the packing element to seal the annulus between the tubing string and the casing uphole of the second location. The method includes pumping fluid down the tubing string to fracture the second location, providing a second plug comprises of proppant and polymer proximate the second location, and pumping fluid down the horizontal wellbore to bridge off the second plug to hydraulically isolate the second location.

The first and second locations may have been previously fractured and pumping fluid down the tubing string may re-fracture the first and second locations. The method may include removing the first and second plugs and producing hydrocarbons from the re-fractured first and second previously fractured locations. The first and second plugs may comprise a lightweight filler combined with proppant and polymer.

Figure 1:
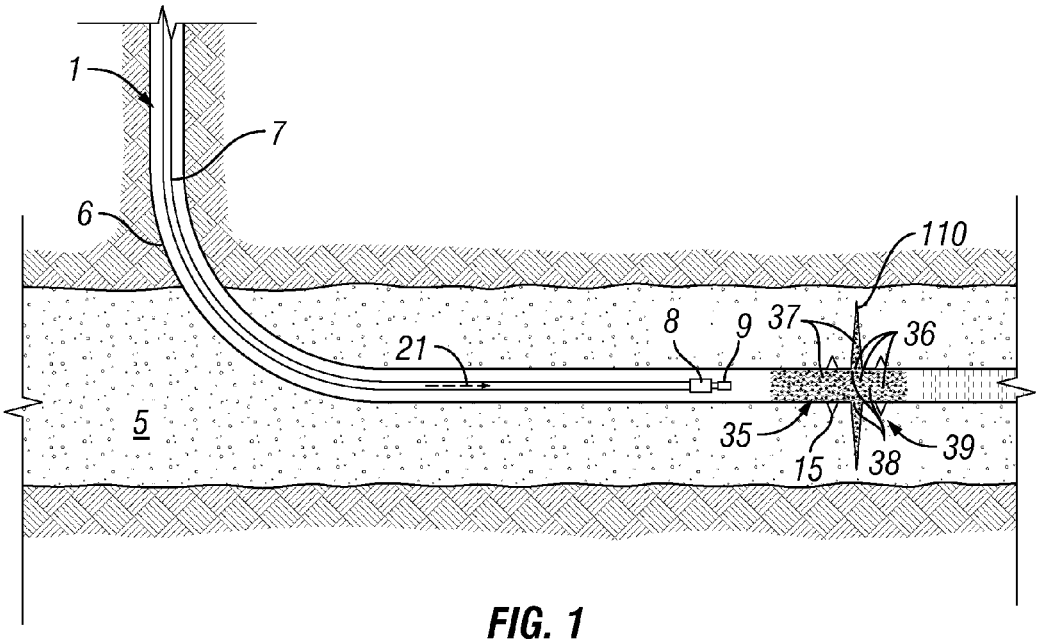
FIG. 1 shows an embodiment of a wellbore isolation pill comprised of a combination of proppant, lightweight filler, and polymer positioned adjacent a location of a wellbore that previously has been hydraulically fractured.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

Figure 2:
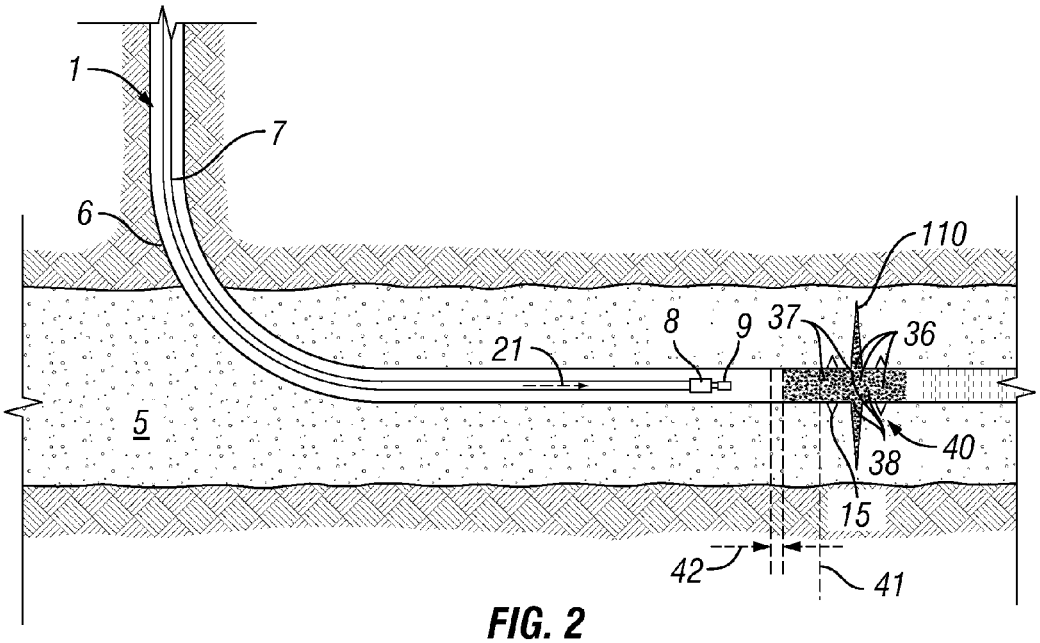
FIG. 2 shows the pill of proppant, lightweight filler, and polymer formed info a plug to hydraulically isolate a location of a wellbore that previously has been hydraulically fractured.

FIG. 1 shows coiled tubing string 7 positioned within the casing 6 of a wellbore 1. The coiled tubing 6 is used to position a fluid pill comprised of proppant 36, lightweight filler 38, and polymer 37 at a location adjacent and/or proximate to a previously fractured location that has been re-fractured 110. A fluid pill 35 comprising proppant 36, lightweight filler 38, and polymer 37 is used to selectively hydraulically isolate the re-fractured location 110, as detailed herein. After the placement of the fluid pill 35 of proppant 36, lightweight filler 38, and polymer 37, fluid is slowly pumped down the coiled tubing 7 as indicated by arrow 21. The pumped fluid causes the pill 35 to start to bridge off 39 as shown in FIG. 1. The bridging off pill 39 may hydraulically isolate the re-fractured location 110 as well as perforations 15 in the casing 6 that may be adjacent to the re-fractured location 110. FIG. 2 shows the pill 35 bridged off to form a plug 40 that hydraulically isolates a portion of the wellbore 1 including the re-fractured location 110. The plug 40 may be used to hydraulically isolate re-fractured location 110, perforations in the wellbore 1, and/or a newly perforated location within the wellbore 1 that may have been recently fractured for the first time. The plug 40 may be used to hydraulically isolate, at the same time, both perforations 15 used for re-fracturing the formation as well as new perforations 15 made in the casing of the wellbore 1.

It is known to hydraulically isolate a portion of wellbore 1 with a plug, such as a sand plug. However, building such a plug can be a difficult process in a horizontal wellbore 1 due to gravitational settling of the material used to build the plug. U.S. Pat. No. 7,735,556 entitled Method of Isolating Open Perforations in Horizontal Wellbores Using an Ultra Light-weight Proppant, which is incorporated by reference herein in its entirety, discloses the use of ultra-lightweight proppant and/or neutrally buoyant proppant to the formation of a plug to hydraulically isolate a portion of a horizontal wellbore 1. As used herein, ultra-lightweight proppant may have a specific gravity of 1.05 to 1.75 or proppant that has approximately 50% the density of sand conventionally used as proppant in the fracturing of a well formation. The use of plugs to hydraulically isolate portions of a wellbore 1 are also disclosed in U.S. Pat. No. 7,870,902 entitled Method for Allowing Multiple Fractures to be Formed in a Subterranean Formation from an Open Hole Well and U.S. Pat. No. 8,596,362 entitled Hydraulic Fracturing Methods and Well Casing Plugs, both of which are incorporated by reference herein in its entirety. The ultra-lightweight proppant may be LiteProp™ ultra-lightweight proppants offered commercially by Baker Hughes of Houston, Tex. The use of a plug comprised of ultra-lightweight or neutrally buoyant proppant may not be sufficient to withstand the pressures used during the re-fracturing of adjacent locations within the wellbore 1. The addition of a polymer 37 to the pill 35 may form a plug 40 capable of withstanding higher pressures within the wellbore 1.

During typical oil field operations that occur in the construction of a wellbore 1, polymers, such as hydrophobically modified polysaccharides, may be used in an effort to prevent potential damage to the formation from an unwanted loss of fluids into the reservoir rock. An example of one such polymer is SealBond™ offered commercially by Baker Hughes of Houston, Tex. The SealBond™ is a cement spacer additive that is comprised of crystalline silica. The SealBond™forms a non-invasive seal to help prevent filtrate invasion into the producing formation, or into neighboring geological formations. It is not known in the art of sand plugs to use a polymer to hydraulically isolate a portion of a wellbore during an initial hydraulic fracturing stimulation treatment or in a re-fracturing procedure. The addition of a polymer to proppant, and ultra-lightweight or neutrally buoyant proppant, and lightweight filler materials in a fluid pill. 35 may form a plug 40 adequate to hydraulically isolate a portion of a wellbore 1 during a re-fracturing process.

Various polymers may be used in combination with the proppant to form a plug to hydraulically isolate a portion of the wellbore 1. For example, a cement fluid loss additive such as a HEC polymer, and/or a superabsorbent polymer may be used. The polymer used on combination with proppant to form an isolation plug may be a cross-linked polymer. The polymer may be gelled or non-gelled. Other examples of polymers that may be used with proppant to form a plug include, but are not limited to a polymer capable of forming linear or cross-linked gels such as galactomannan gums, guars, derivatized guars, cellulose and cellulose derivatives, starch, starch derivatives, xanthan, derivatized xanthan and mixtures thereof. Additional examples of potential polymers include, but are not limited to guar gum, guar gum derivative, locust bean gum, welan gum, karaya gum, xanthan gum, scleroglucan, diutan, cellulose and polymer derivatives such as carboxymethyl hydroxypropyl guar (CMHPG), hydroxyethyl cellulose (HEC), carboxymethyl hydroxyethyl cellulose (CMHEC), carboxymethyl cellulose (CMC), and dialkyl carboxymethyl cellulose.

The fluid pill 35 may include a cross-linking agent suitable for cross-linking the polymer. Examples of potential cross-linking agents include, but are not limited to, metal ions such as aluminum, antimony, zirconium and titanium-containing compounds, including organotitanates. Examples of suitable cross-linking agents may also be found in U.S. Pat. Nos. 5,201,370; 5,514,309, 5,247,995, 5,562,160, and 6,100,875, each of which is incorporated herein by reference. Additional examples of potential cross-linking agents include, but are not limited to, borate-based crosslinkers such as organo-borates, mono-borates, poly-borates, and mineral borates.

The polymer may be a superabsorbent polymer (SAP) that is a cross-linked, neutralized or partially neutralized polymer that is capable of absorbing large amount of aqueous liquids, such as water, brine, acid, or base, with swelling and the formation of a gel or viscous material, and retains the absorbed fluid under certain pressures and/or temperatures. The SAP may be configured to expand into an expanded state within a fluid. In the expanded state, the SAP may be configured to break in response to a breaking condition and form a decomposed polymer. The SAP may include a plurality of polymer chains having internal crosslinks between the chains. Proppant particles may be includes within a space between adjacent SAP particles. Proppant particles may be confined within the space between adjacent SAP particles by intra-particle crosslinks.

The SAP may have a hydrophilic network that retains large amounts of aqueous liquid relative to the weight of the SAP. The SAP may be a variety of organic polymers that react with or absorb water and swell when contacted with an aqueous fluid. Some examples of SAP are polysaccharide material (that, e.g., in dry state, absorbs and retains a weight amount of water equal to or greater than its own weight), poly (2-hydroxyethyl) acrylate, poly (alkyl acrylates), polyacrylamide, polymethacrylamide, polyvinylpyrrolidone, and polyvinyl acetate. The SAP may be a copolymer of acrylamide with, for example, maleic anhydride, vinyl acetate, ethylene oxide, ethylene glycol, acrylonitrile, or a combination thereof. Production of SAPs may be from acrylamide (AM) or acrylic acid and its salts.

SAP may be polymerized from nonionic, anionic, cationic monomers, or a combination thereof. Polymerization to form the SAP may be via free-radical polymerization, solution polymerization, gel polymerization, emulsion polymerization, dispersion polymerization, or suspension polymerization. Moreover, polymerization can be performed in an aqueous phase, in inverse emulsion, or in inverse suspension.

Examples of nonionic monomers for making the SAP include nonionic monomers such as acrylamide, methacrylamide, N,N-di($C_1$-$C_8$ alkyl)acrylamide such as N,N-dimethylacrylamide, vinyl alcohol, vinyl acetate, allyl alcohol, hydroxyethyl methacrylate, acrylonitrile, and derivatives thereof. Such derivatives include, for example, acrylamide derivatives, specifically alkyl-substituted acrylamides or aminoalkyl-substituted derivatives of acrylamide or methacrylamide, and are more specifically acrylamide, methacrylamide, N-methylacrylamide, N-methylmethacrylamide, N,N-dimethylacrylamide, N-ethylacrylamide, N,N-diethylacrylamide, N-cyclohexylacrylamide, N-benzylacrylamide, N,N-dimethylaminopropylacrylamide, N,N-dimethylaminoethylaciylamide, N-tert-butylacrylamide, N-vinylformamide, N-vinylacetamide, acrylonitrile, methacrylonitrile, or a combination thereof.

Examples of anionic monomers for making the SAP include ethylenically unsaturated anionic monomers containing acidic groups including a carboxylic group, a sulfonic group, a phosphonic group, a salt thereof, a derivative thereof, or a combination thereof. The anionic monomer may be acrylic acid, methacrylic acid, ethacrylic acid, maleic acid, maleic anhydride, fumaric acid, itaconic acid, α-chloroacrylic acid, β-cyanoacrylic acid, β-methylacrylic acid (crotonic acid), α-phenylacrylic acid, β-actyloyloxypropionic acid, sorbic acid, α-chlorosorbic acid, 2'-methylisocrotonic acid, cinnamic acid, p-chlorocinnamic acid, β-stearyl acid, citraconic acid, mesaconic acid, glutaconic acid, aconitic acid, 2-acrylamido-2-methylpropanesulphonic acid, allyl sulphonic acid, vinyl sulphonic acid, allyl phosphonic acid, vinyl phosphonic acid, or a combination thereof.

Examples of cationic monomers for making the SAP include an N,N-di-$C_1$-$C_8$ alkylamino-$C_1$-$C_8$ alkylacrylate (e.g., N,N-dimethyl amino ethyl acrylate), N,N-di-$C_1$-$C_8$ alkylamino-$C_1$-$C_8$ alkylmethacrylate (e.g., N,N-dimethyl amino ethyl methacrylate), including a quaternary form (e.g., methyl chloride quaternary forms), diallyldimethyl ammonium chloride, N,N-di-$C_1$-$C_8$ alkylamino-$C_1$-$C_8$ alkylacrylamide, and a quaternary form thereof such as acrylamidopropyl trimethyl ammonium chloride. Various SAP polymers are disclosed in U.S. patent application Ser. No. 13/888,457 entitled Hydraulic Fracturing Composition, Method for Making and Use of Same and U.S. patent application Ser. No. 14/169,698 entitled Hydraulic Fracturing Composition, Method for Making and Use of Same, both of which are incorporated herein by reference.

FIGS. 1 and 2 show a fluid pill 35 delivered to a specified location of a wellbore 1 that is comprised of proppant 36, lightweight filler material 38, and polymer 37. The proppant may be ultra-lightweight or neutrally buoyant proppant. The fluid pill 35 may be slowly squeezed by the pumping of fluid down the wellbore 1 to bridge off and form a plug 40 as shown in FIG. 2. In one embodiment, the fluid pill 35 is comprised of a polymer 37 and ultra-lightweight or neutrally buoyant proppant 36. The addition of polymer 37 may permit the plug to hold and hydraulically isolate the formation at pressures that exceed a plug 40 formed from proppant, and ultra-lightweight or neutrally buoyant proppant 36, and lightweight filler materials 38.

The addition of a polymer 37 to proppant 36 may form a fluid pill 35 that has less movement (i.e. shrinkage of length) within the casing 6 while the pill 35 is compressed into a plug 40 than a convention fluid pill 35 comprised of proppant 36 alone. The decrease in movement of the pill 35 is due to the reduction of water that may be removed from the pill/plug due to leakage during the formation of the plug 40 within the wellbore 1. The leakage of water from the pill 35 causes the shrinkage of the overall size of the plug 40 when it is formed within the wellbore 1. As the pill 35 is slowly squeezed by pumping fluid down the wellbore 1, the pill 35 is pushed into the re-fractured locations 110 and water is squeezed out of the pill/plug causing a reduction of size in the plug 40 when it is formed. The addition of the polymer 37 reduces the amount of water that may be squeezed out during the formation of the plug 40, which results in a larger plug 40 in comparison to a conventional proppant plug as shown in FIG. 2. The polymer 37 may be a cross-linked polymer when the pill 35 is positioned within the horizontal wellbore. The cross-linking of the polymer 36 may further improve the ability of the plug 40 to resist movement, shrinkage, or to be displaced due to pressure from above the plug 40 during a hydraulic fracturing treatment. FIG. 2 shows that dotted line 41 that represents the size of a conventional proppant plug. The addition of a polymer 37 results in a relatively small decrease in length, 42, of the plug 40 in comparison to the length of the pill 35. As a result, the plug 40 comprised of proppant 36 and a polymer 37 may provide better isolation properties than a plug 40 comprised of proppant solely 36.

Figure 3:
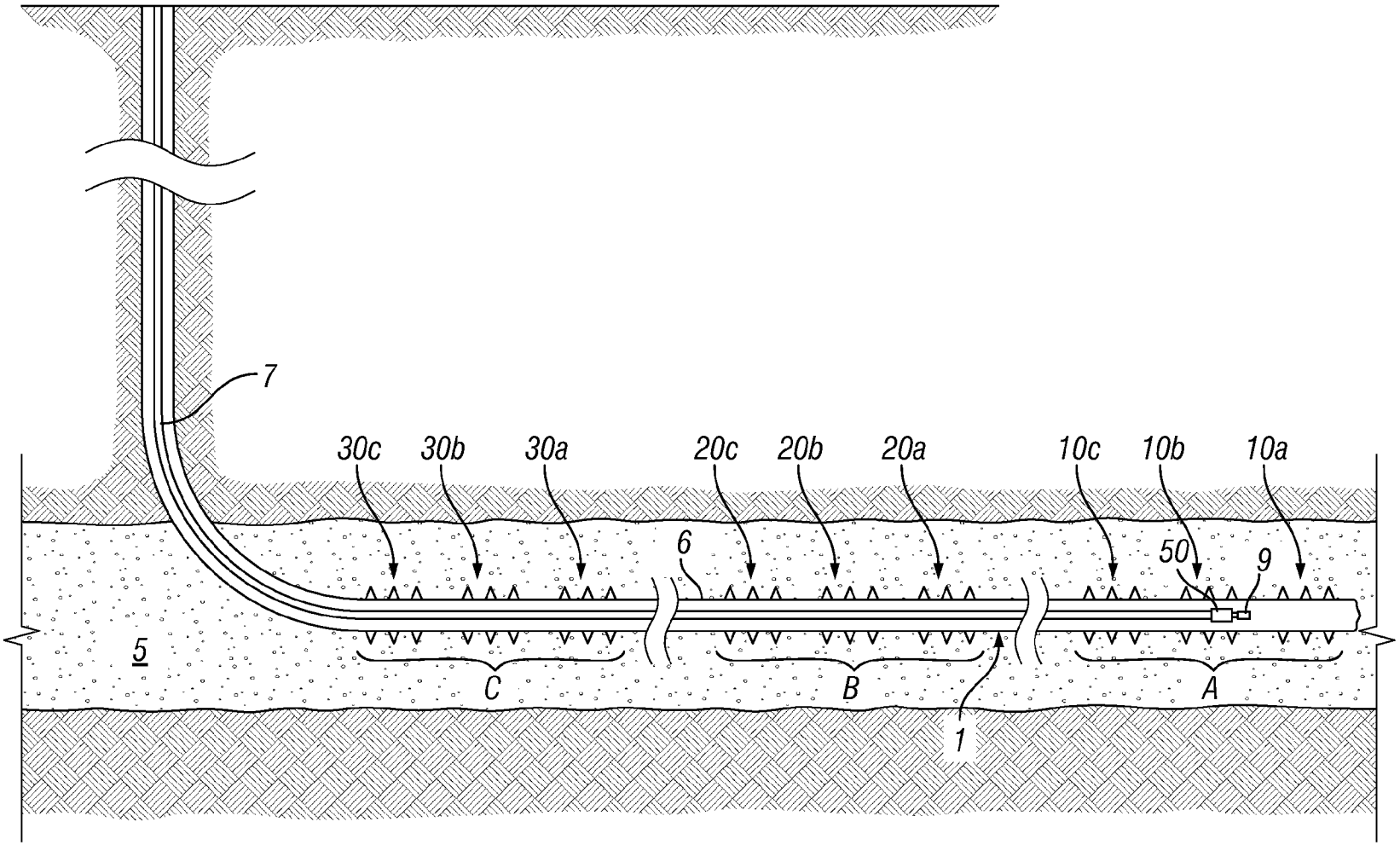
FIG. 3 shows a tubing string positioned in a portion of a multizone horizontal wellbore that includes a plurality of locations that previously have been hydraulically fractured.

FIG. 3 shows a schematic of a multizone horizontal wellbore 1 within a well formation 5. The horizontal wellbore 1 includes a plurality of zones A, B, and C that each may contain a plurality of locations 10*a*, 10*b*, 10*c*, 20*a*, 20*b*, 20*c*, 30*a*, 30*b*, and 30*c* that have been previously fractured. The locations 10*a*, 10*b*, 10*c*, 20*a*, 20*b*, 20*c*, 30*a*, 30*b*, and 30*c* may be prior fractures, fracture clusters, or perforations within a casing. As discussed herein, each location may include one or more fracture clusters that have been previously fractured or were attempted to be previously fractured. Although the figures only show a multizone horizontal wellbore with cemented casing, the location may also be a fracture sleeve or a fracture port in a ported completion that has been left open after a prior fracturing operation in an attempt to fracture the formation behind the fracture port. For example, the system and method disclosed herein may be used to re-fracture the formation 5 through the ported completion disclosed in U.S. patent application Ser. No. 12/842,099 entitled Bottom Hole Assembly With Ported Completion and Methods of Fracturing Therewith, filed on Jul. 23, 2010 by John Edward Ravensbergen and Lyle E. Laun, which is incorporated by reference herein in its entirety.

For illustrative purposes only, FIG. 3 shows three zones or segments of the multizone horizontal wellbore 1. Likewise, FIG. 3 shows three previously fractured locations per zone or segment, for illustrative purposes only. A multizone horizontal wellbore 1 may include a various number of zones or segments such as A, B, and C that have been previously fractured, as would be appreciated by one of ordinary skill in the art having the benefit of this disclosure. Likewise, the number of previously fractured locations within each zone or segment may vary. As discussed above, the previously hydraulically fractured locations may comprise a perforation through casing that was attempted to be fractured, a fracture or fracture cluster in the formation, or a fracture port in a completion, A previously fractured location includes any location within a wellbore that has been previously subjected to a fracturing treatment, in an attempt to fracture the formation at that location, whether or not the formation actually fractured. Hereinafter, the previously fractured locations will be referred to as a fracture cluster, but such locations should not be limited to those previously fractured locations that resulted in a fracture cluster and may include any of the above noted, or other fracture locations.

A production zone may have as few as a single fracture cluster or may include more than ten (10) fracture clusters. The multiple zones of a multizone horizontal wellbore 1 may include a plurality of fracture clusters 10, 20, and 30 that extend into the formation 5 that surrounds the casing 6 of the multizone horizontal wellbore 1. As discussed above, the formation 5 is fractured by a plurality of fracture clusters 10, 20, and 30 to increase the production of hydrocarbons from the wellbore. When the rate of production from the horizontal wellbore decreases below a minimum threshold value it may be necessary to re-fracture selected fracture clusters 10, 20, and 30 within the wellbore 1, as discussed below.

Figure 4:
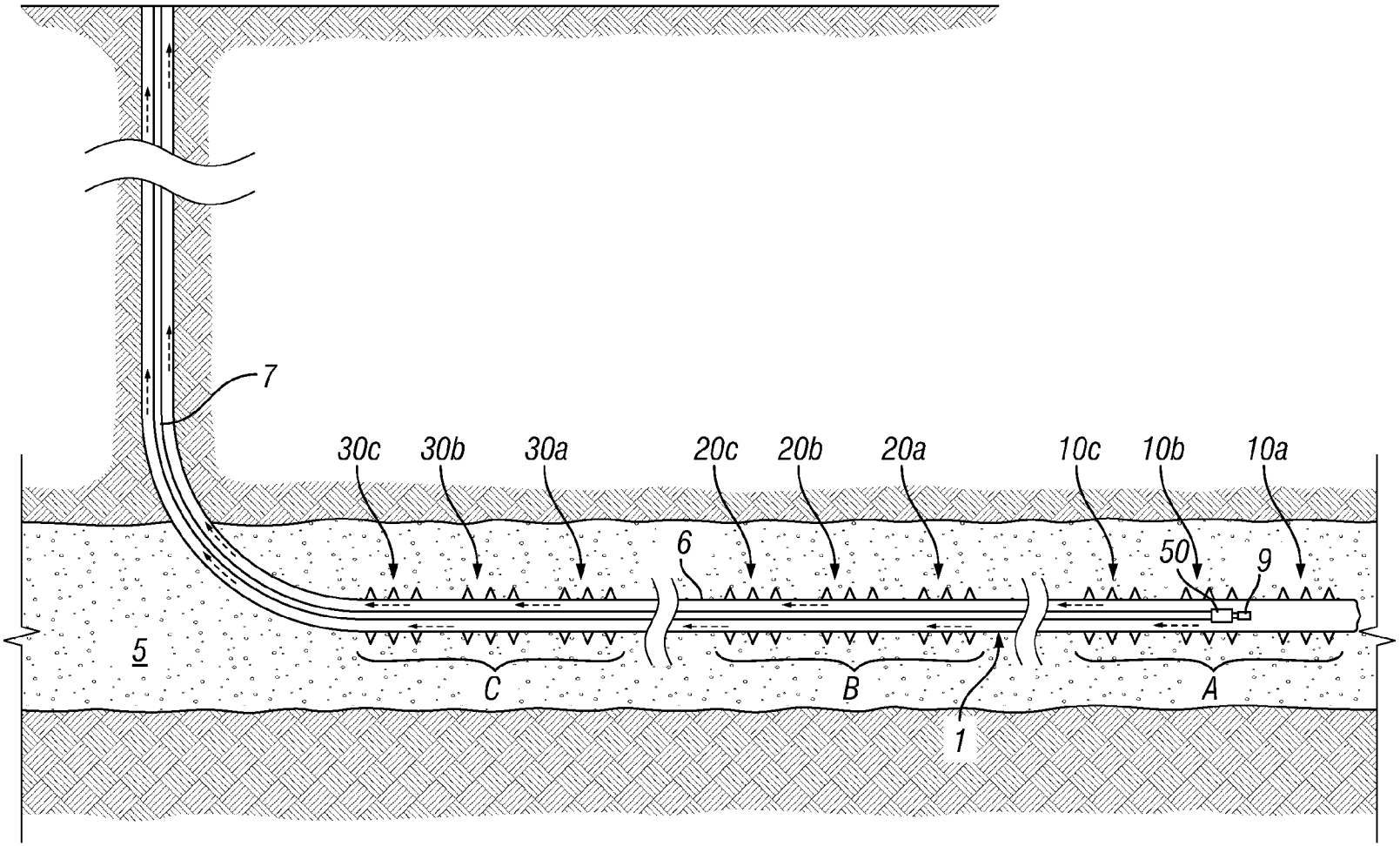
FIG. 4 shows a tubing string providing a cleanout procedure on a portion of a multizone horizontal wellbore that includes a plurality of locations that previously have been hydraulically fractured.

A tubing string 7 may be positioned within the casing 6 of the horizontal wellbore 1. Fluid may be pumped down the tubing string 7 and out the end 9 of the tubing string and reverse circulated up the annulus to clean out the horizontal wellbore 1 prior to the re-fracturing process as shown in FIG. 4. The tubing string 7 may include a testing device 50 that may be used to determine whether a fracture cluster, such as 10*a*, 10*b*, 10*c*, 20*a*, 20*b*, 20*c*, 30*a*, 30*b*, or 30*c*, should be re-fractured. For example, the testing may be a logging device. The testing device 50 may indicate that a fracture cluster should be skipped in the re-fracturing process. The testing device 50 may determine various parameters that may be helpful to determine whether a location should be re-fractured such as casing integrity, wellbore characterization, formation evaluation, and/or production analysis. The testing device 50 may be a diagnostic device positioned within the interior of a coiled tubing string 7 as disclosed in pending and related U.S. application Ser. No. 14/264,794 entitled Coiled Tubing Downhole Tool filed on Apr. 29, 2014 by Juan Carlos Flores, which is incorporated by referenced in its entirety herein.

After the horizontal wellbore 1 has been cleaned out, a tubing string 7 may be positioned within the casing 6 of the horizontal wellbore 1 having a packer or sealing element 8, hereinafter referred to as a packer. The packer 8 may be actuated to create a seal in the annulus between the tubing string 7 and the casing. The tubing string 7 may be comprised of various tubulars that permit locating and operating a packer or sealing element, as discussed below, within the horizontal wellbore I and also permit the pumping of fluid down the tubing string 7 to a desired location along the horizontal wellbore 1. For example, the tubing string 7 may be coiled tubing that extends from the surface to the location of the fracture cluster 10*a* positioned farthest downhole of the horizontal wellbore 1. Another example is a tubing string 7 comprised of a rigid tubular section 70 connected to coiled tubing 75, as shown schematically in FIG. 12. It may be preferred use only a relative short length of rigid tubing 70 in comparison to the overall length of the tubing string 7 due to the greater weight of rigid tubing 70 in comparison to coiled tubing 75.

Figure 5:
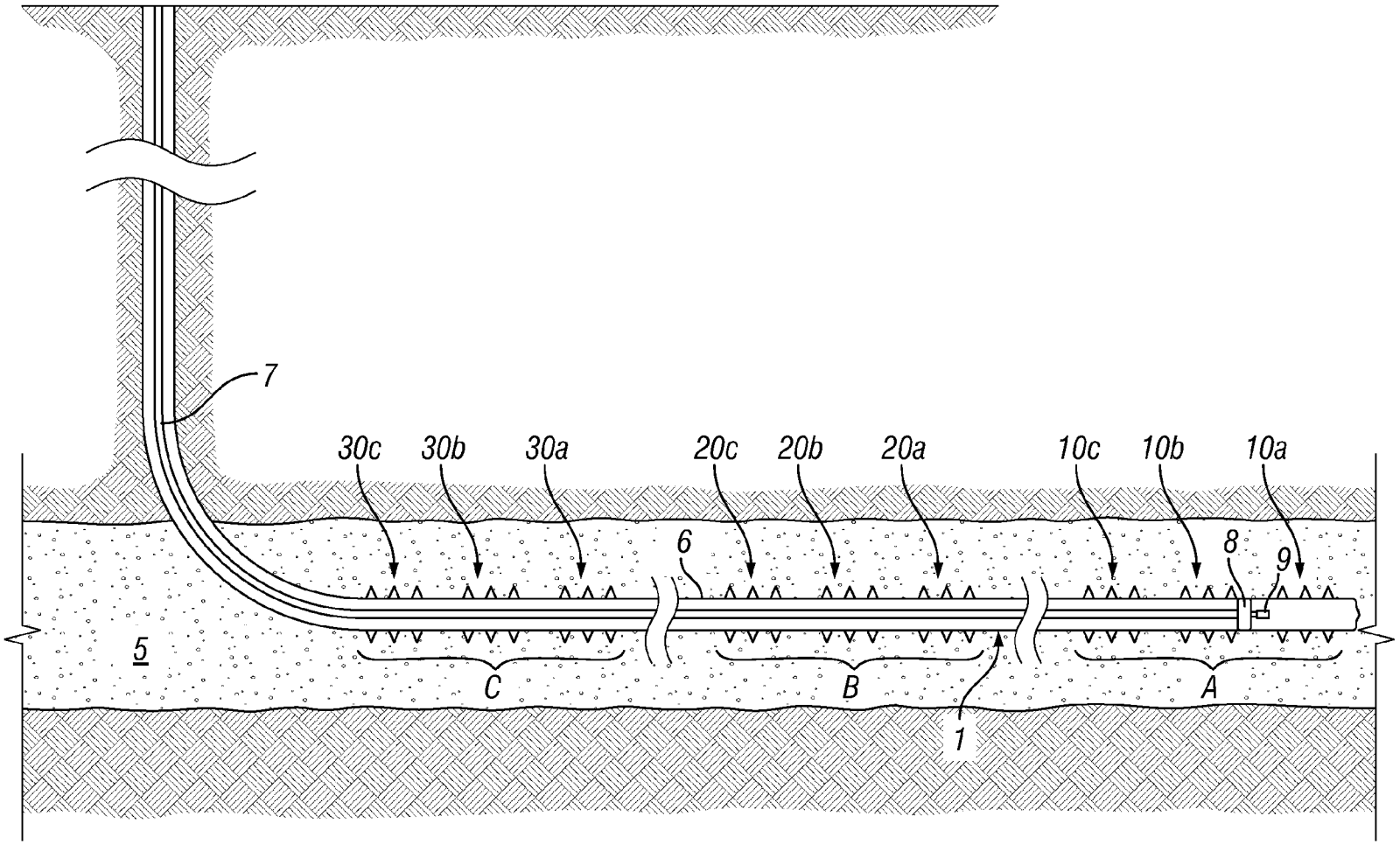
FIG. 5 shows an actuated packer on a tubing string creating a seal above the lowermost location of a multizone horizontal wellbore that has previously been hydraulically fractured.

The packer 8 may be positioned uphole of the lowermost fracture cluster 10*a* and actuated to create a seal between the tubing string 7 and the casing 6 of the horizontal wellbore 6. FIG. 5 shows the packer 8 actuated to hydraulically isolate the lowermost fracture cluster 10*a* from the portion of the horizontal wellbore 1 located above the actuated packer 8. Various packers and/or sealing elements may be used to in connection with the tubing string 7 to hydraulically isolate the fracture cluster 10*a* as would be appreciated by one of ordinary skill in the art having the benefit of this disclosure.

The packer 8 includes a sealing element may be repeatedly actuated and/or energized to create a seal between the tubing string 7 and the wellbore casing 6. Debris within the annul us may potentially interfere with the repeated actuation of the packer 8. In an effort to minimize interference from debris within the wellbore 1, the packer 8 may include a debris exclusion device, such as one or more cups, positioned downhole from the packing element, which may help to prevent debris and/or material within the wellbore from interfering with the creation of a seal by the sealing element of the packer 8. One example of such a packing element is discussed in U.S. Pat. No. 6,315,041 to Stephen L. Carlisle and Douglas J. Lehr entitled Multi-zone Isolation Tool and Method of Stimulating and Testing a Subterranean Well, which is incorporated by reference herein in its entirety.

Figure 6:
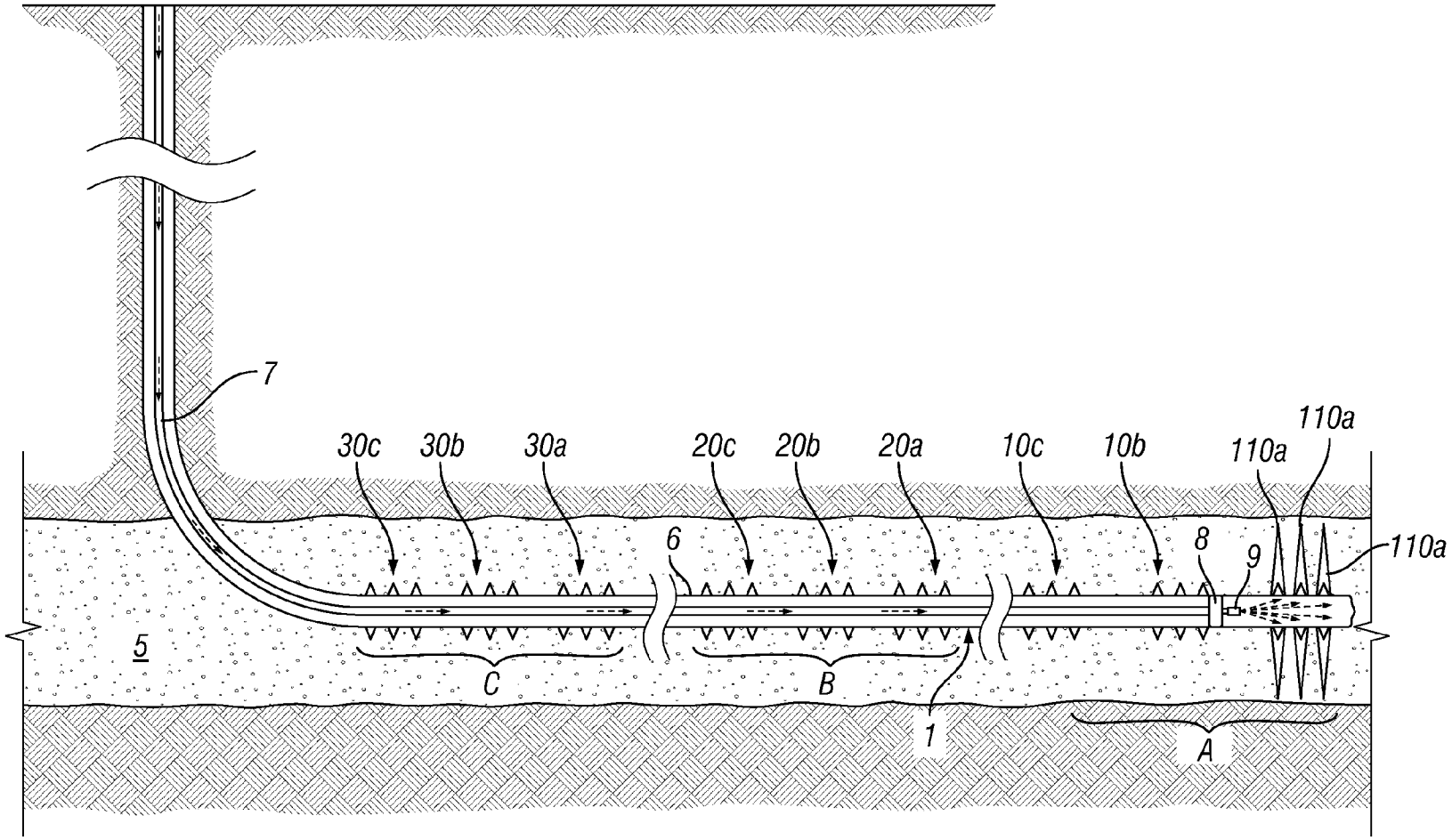
FIG. 6 shows re-fracturing the lowermost fracture location of a multizone horizontal wellbore.
Figure 7:
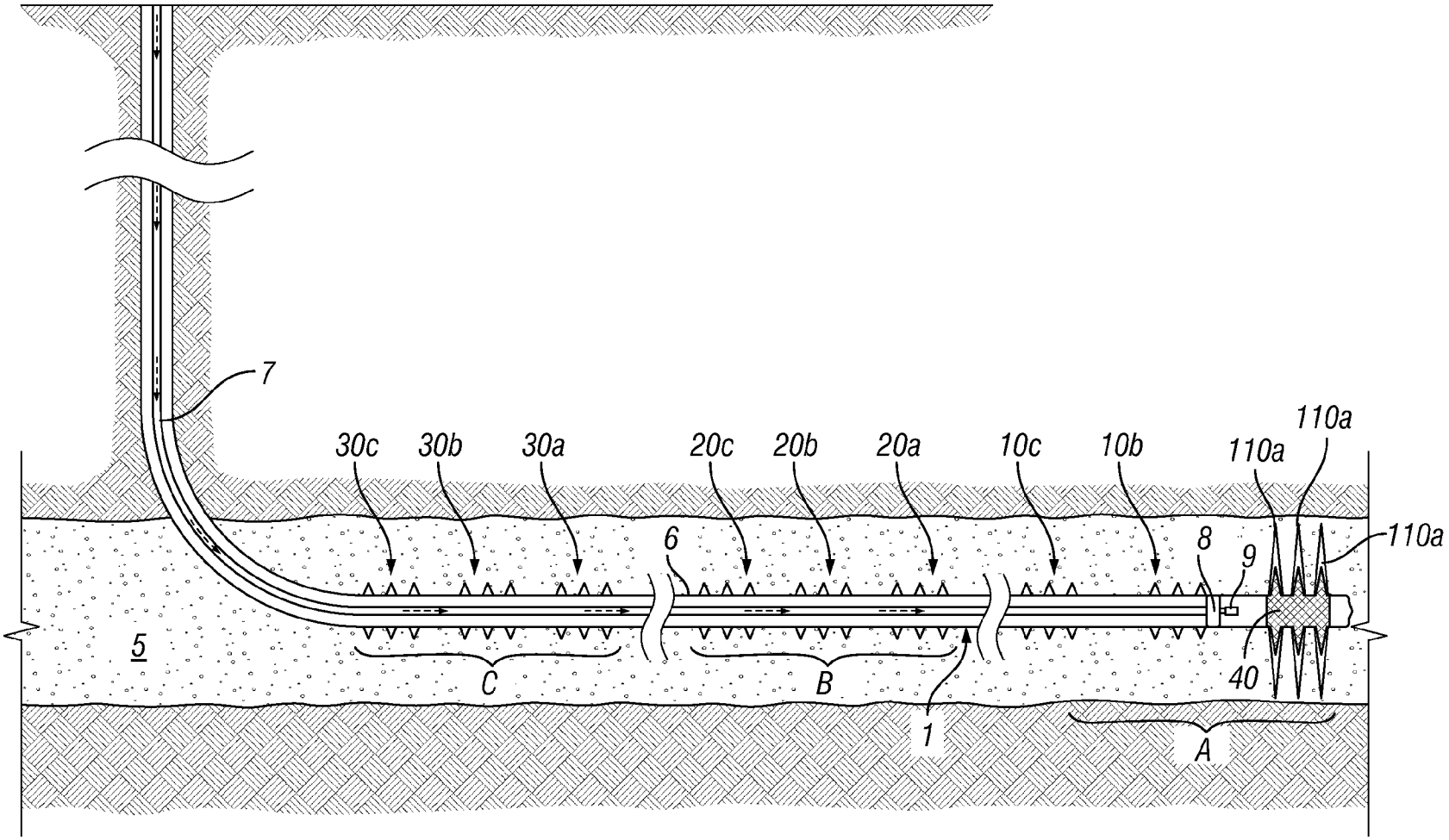
FIG. 7 shows the placement of a plug to hydraulically isolate the lowermost location after it has been re-fractured.

FIG. 6 showrs that fluid is pumped down the tubing string 7 and out the end 9 of the tubing string 7 to hydraulically re-fracture cluster 110*a*, which wras previously fractured fracture cluster 10*a* (shown in FIG. 3-5). After re-fracturing cluster 110*a*, a plug 40 comprised of proppant and a polymer may be placed within the horizontal wellbore 1 proximate to the re-fractured cluster 110*a* as shown in FIG. 7. As discussed herein, the plug 40 may formed from a pill 35 comprised of proppant 36 and polymer 37 that is slowly squeezed to bridge off within the wellbore 1 and form a plug 40. The plug 40 hydraulically isolates the re-fractured cluster 110*a* from subsequent re-fracturing procedures within the horizontal wellbore 1. The plug 40 may be comprised of a polymer in combination with ultra-lightweight proppant and/or neutrally buoyant proppant and/or lightweight filler materials. The pill 35 that forms the plug 40 is pumped down the tubing string 7 and positioned proximate to the re-fractured cluster 110*a* to hydraulically isolate the re-fractured cluster 110*a* during the re-fracturing process of an additional fracture cluster within the horizontal wellbore 1. The plug 40 is shown schematically in FIG. 5 for illustrative purposes only. The actually shape, length, and/or configuration of the plug 40 may be varied as would be appreciated by one of ordinary skill in the art having the benefit of this disclosure.

After the formation of the plug 40 to isolate a re-fractured cluster 110*a* the tubing string 7 may be moved uphole to position the packer 8 above the next fracture cluster 10*b* that is to be re-fractured. As discussed below, the adjacent fracture cluster may not be the next fracture cluster to be re-fractured. Instead, a fracture cluster or multiple fracture clusters may be passed over during the re-fracturing process. A pill 35 may be pumped down the tubing string 7 to form a plug 40 and isolate a passed over fracture cluster during the re-fracturing of the next fracture cluster.

Figure 8:
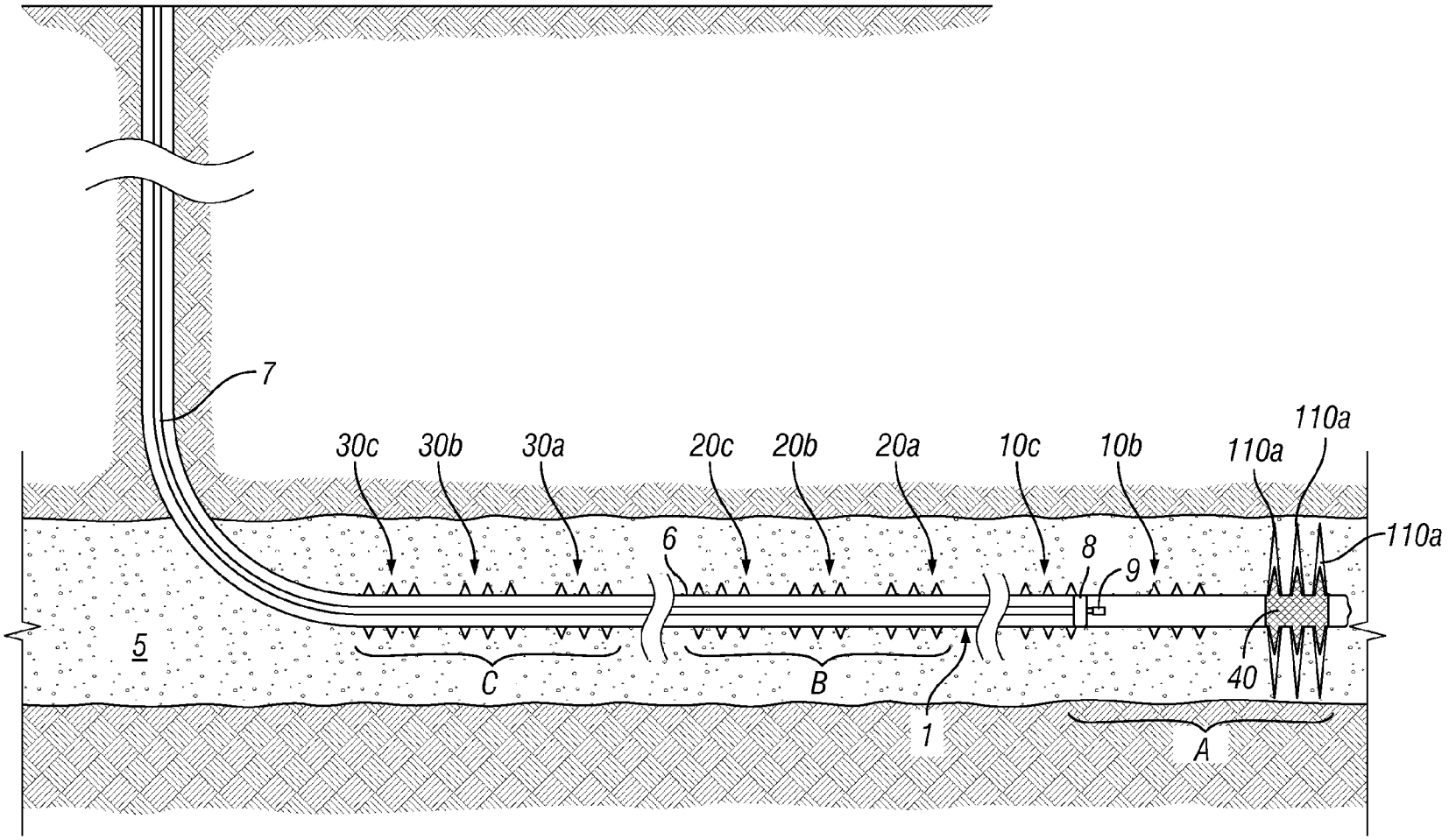
FIG. 8 shows an actuated packer on a tubing string creating a seal above a location that has previously been hydraulically fractured.
Figure 9:
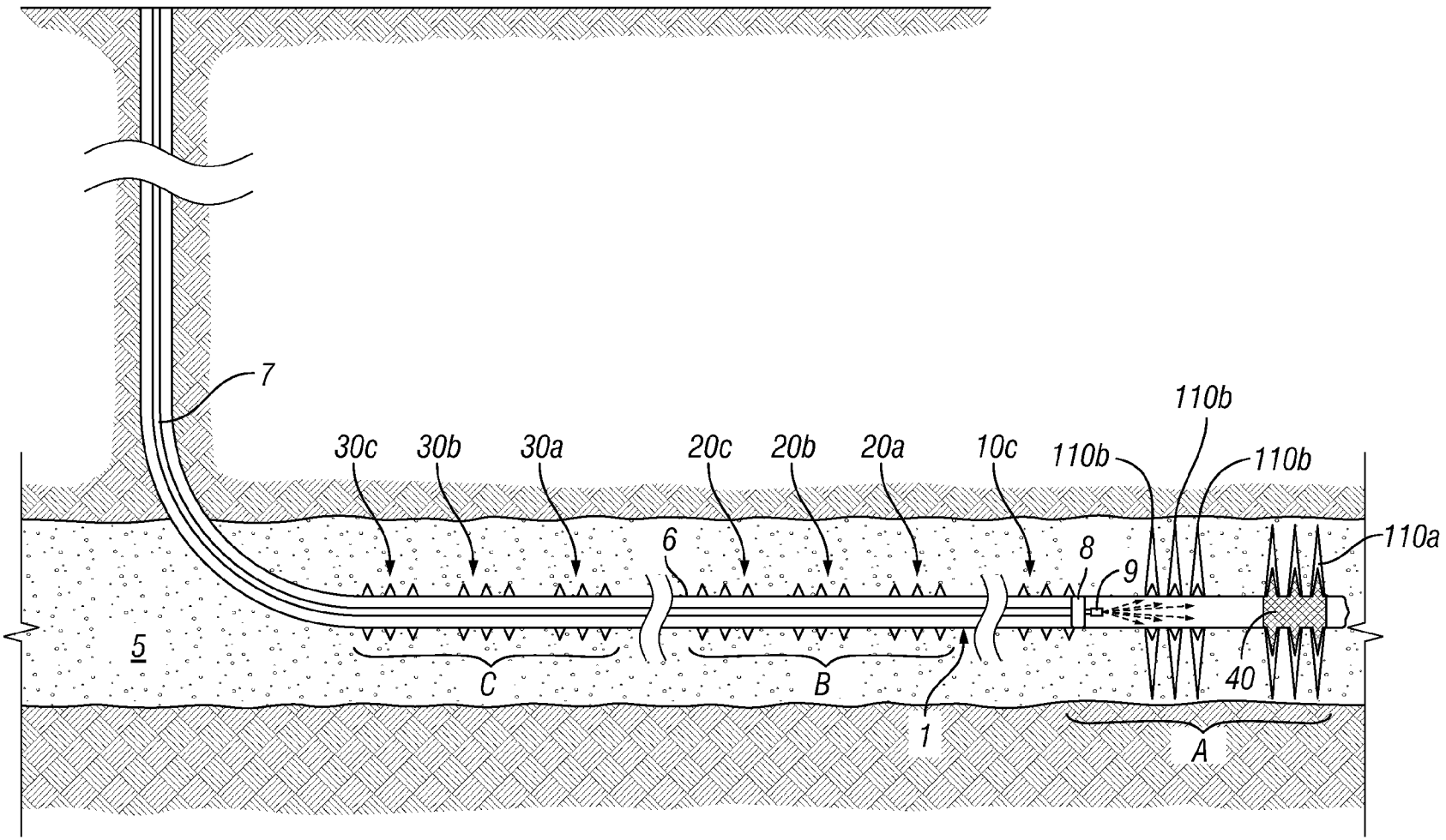
FIG. 9 shows re-fracturing a location of a multizone horizontal wellbore.
Figure 10:
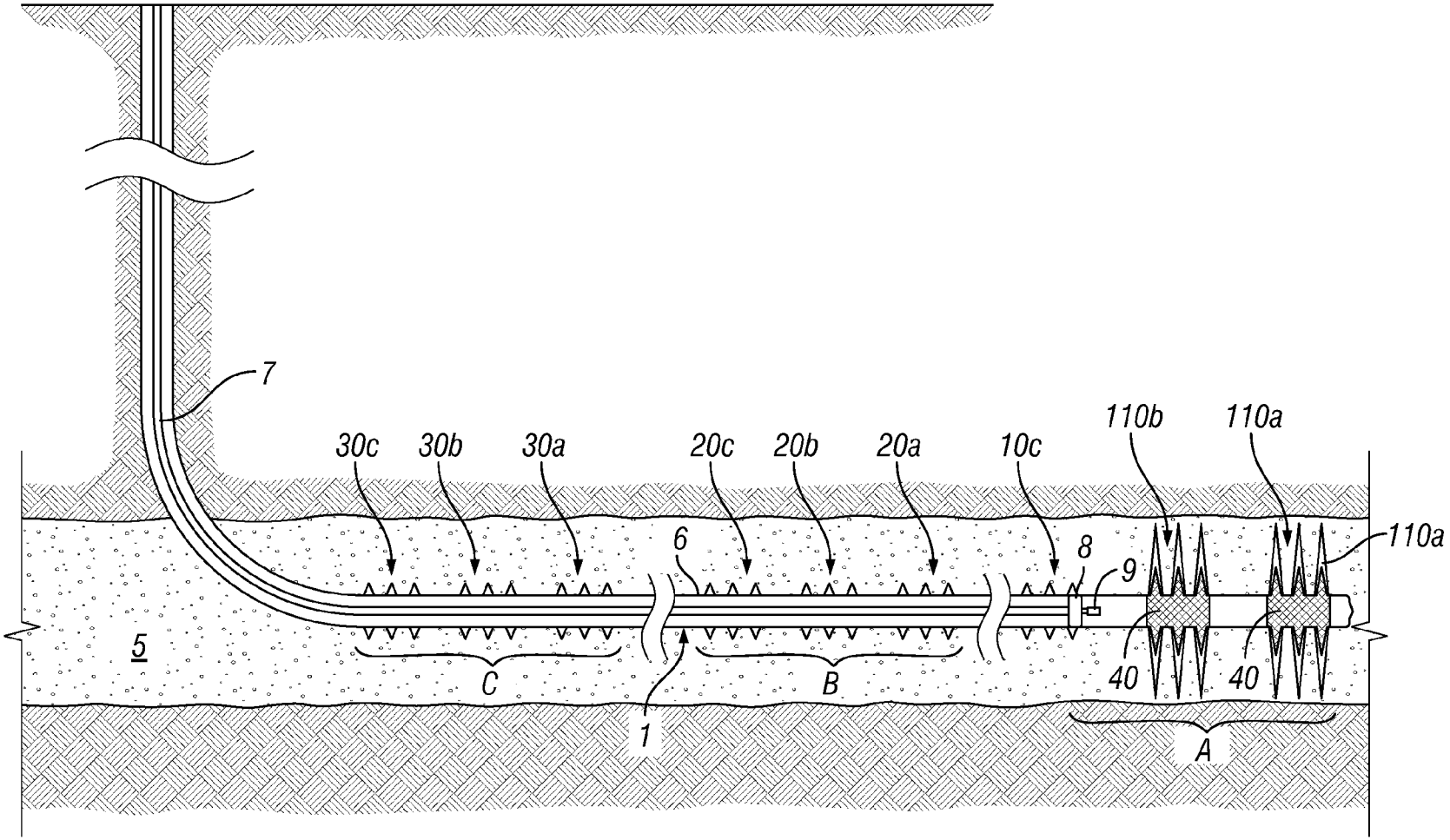
FIG. 10 shows the placement of a plug to hydraulically isolate a location that has been re-fractured as shown in FIG. 9.

FIG. 8 shows the packer 8 actuated to hydraulically isolate the fracture cluster 10*b* from the uphole portion of the horizontal wellbore 1. The plug 40 positioned adjacent the lower re-fractured cluster 110*a* in combination with the actuated packer 8 hydraulically isolates fracture cluster 10*b* from the rest of the horizontal wellbore 1. Once the fracture cluster 10*b* is isolated, fluid may be pumped down the tubing string 7 to re-fracture the cluster 110*b* as shown in FIG. 9. A plug 40 may be formed adjacent the re-fractured cluster 110*b* after the re-fracturing process has been completed to hydraulically isolate the re-fracture cluster 110*b* from the uphole portion of the horizontal wellbore 1, as shown in FIG. 10. Hydraulically isolating the re-fractured cluster 110*b* permits the re-fracturing of another fracture cluster uphole from the re-fractured cluster 110*b*. This process of using a packer 8 and a plug 40 formed of a proppant and polymer may be repeated to re-fracture all desired fracture clusters, as would be recognized by one of ordinary skill in the art having the benefit of this disclosure.

Figure 11:
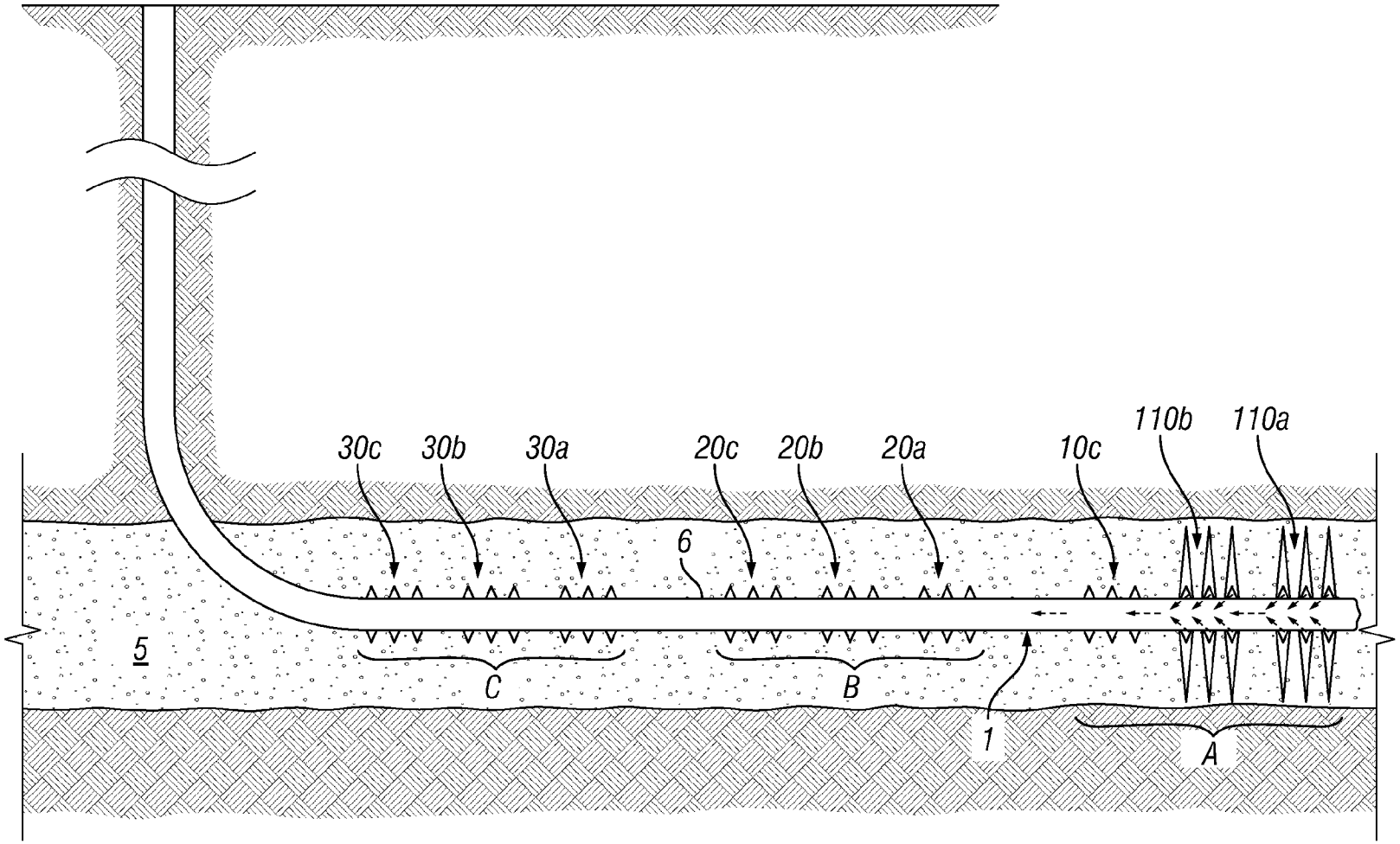
FIG. 11 shows a portion of a multizone horizontal wellbore that has been re-fractured with the tubing string removed, the plugs have been removed from the multizone horizontal wellbore permitting the production of hydrocarbons from the re-fractured locations within the horizontal wellbore.

The plugs 40 placed within the horizontal wellbore 1 to hydraulically isolate sections of the horizontal wellbore need to be removed once it is desired to produce from the hydraulically isolated clusters and/or once all of the desired fracture clusters have been re-fractured. FIG. 11 shows a horizontal wellbore 1 from which all of the plugs 40 adjacent re-fractured clusters 110*a* and 110*b* have been removed permitting production of hydrocarbons from re-fractured clusters 110*a* and 110*b*. The plugs 40 may be removed by various means as would be appreciated by one of ordinary skill in the art having the benefit of this disclosure. For example, the plugs 40 may be removed by performing a clean-out procedure in the horizontal wellbore 1. Alternatively, the plugs 40 may be adapted to dissolve over a predetermined amount of time or dissolve upon the injection of a particular chemical into the horizontal wellbore.

Figure 12:
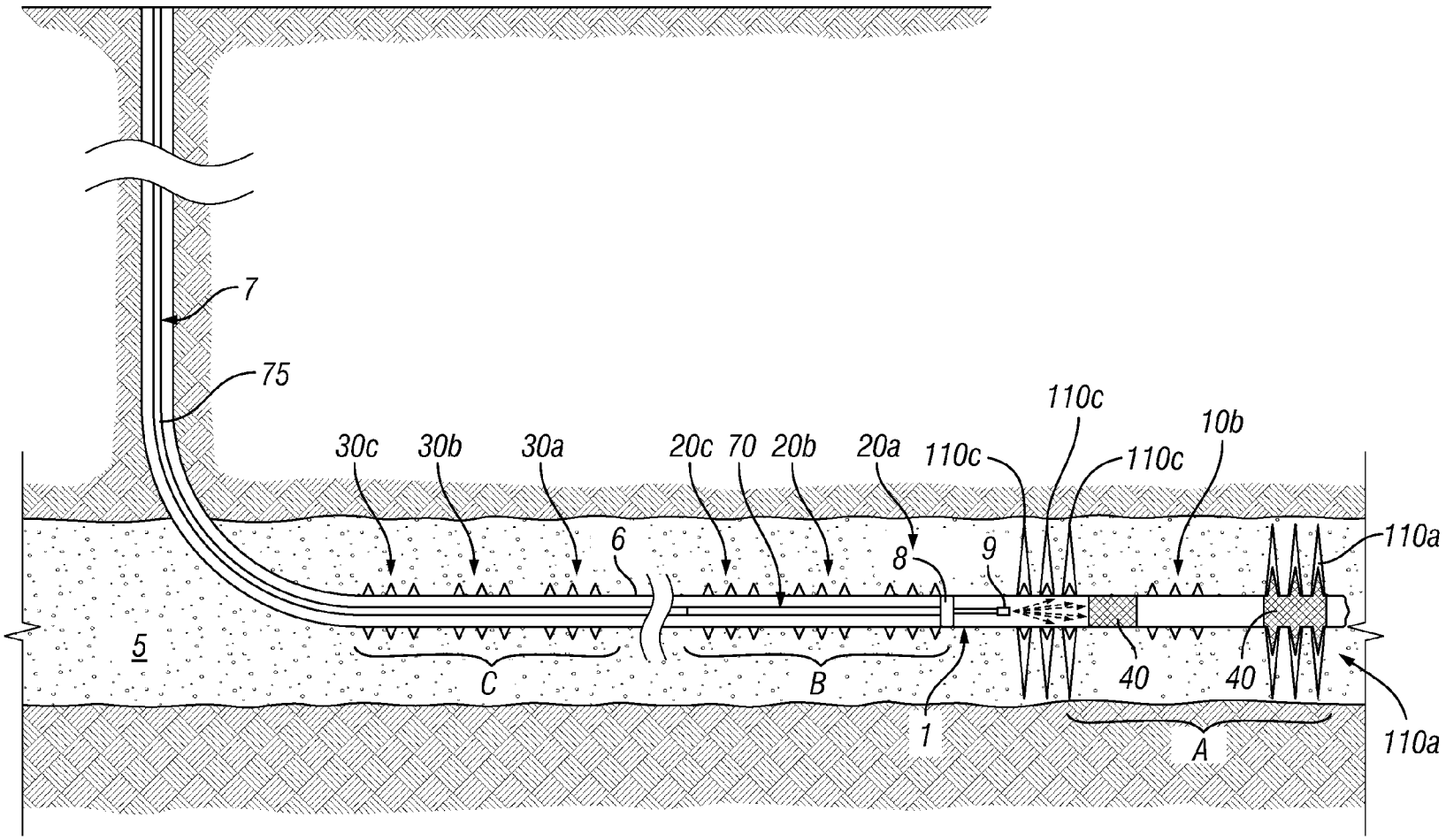
FIG. 12 shows a tubing string comprised of coiled tubing and rigid tubing positioned within a portion of a multizone horizontal wellbore with a plug hydraulically isolating a location that is not to be re-fractured.

FIG. 12 schematically shows a tubing string 7 that is comprised of a coiled tubing 75 connected to a rigid tubular section 70. Due to the length of the horizontal wellbore, it may not be practical to for the entire string 7 to be comprised of rigid tubulars 70, which is heavier than coiled tubing 75. Instead, a short section, in comparison to the length of the horizontal wellbore 1, of rigid tubing 70 may be connected to another type of tubing string, such as coiled tubing 75. As discussed above, a tubing string 7 may include a testing device 50 may have already been used to determine whether a fracture cluster, such as 10*a*, 10*b*, 10*c*, 20*a*, 20*b*, 20*c*, 30*a*, 30*b*, or 30*c*, should be re-fractured. For example, the testing may be a logging device. The testing device 50 may indicate that a fracture cluster should be skipped in the re-fracturing process. For example, FIG. 12 shows that fracture cluster 10*b* was not re-fractured, but instead fracture cluster 10*c* was re-fractured as re-fractured cluster 110*c*. A plug 40 has been formed proximate to fracture cluster 10*b* to isolate fracture cluster 10*b* during the re-fracturing of fracture cluster 110*c*. Prior to pumping fluid down the tubing string 7, the packer 8 is energized above fracture cluster 10*c*. The actuated packer 8 in combination with the plug 40 adjacent to fracture cluster 10*b* isolates fracture cluster 10*c* during the re-fracturing process so that the fluid re-fractures cluster 110*c* and is not leaked off into fracture cluster 10*b*. A plug 40 may be used to isolate multiple fracture clusters that have been determined non-beneficial to re-fracture as would be appreciated by one of ordinary skill in the art having the benefit of this disclosure.

Figure 13:
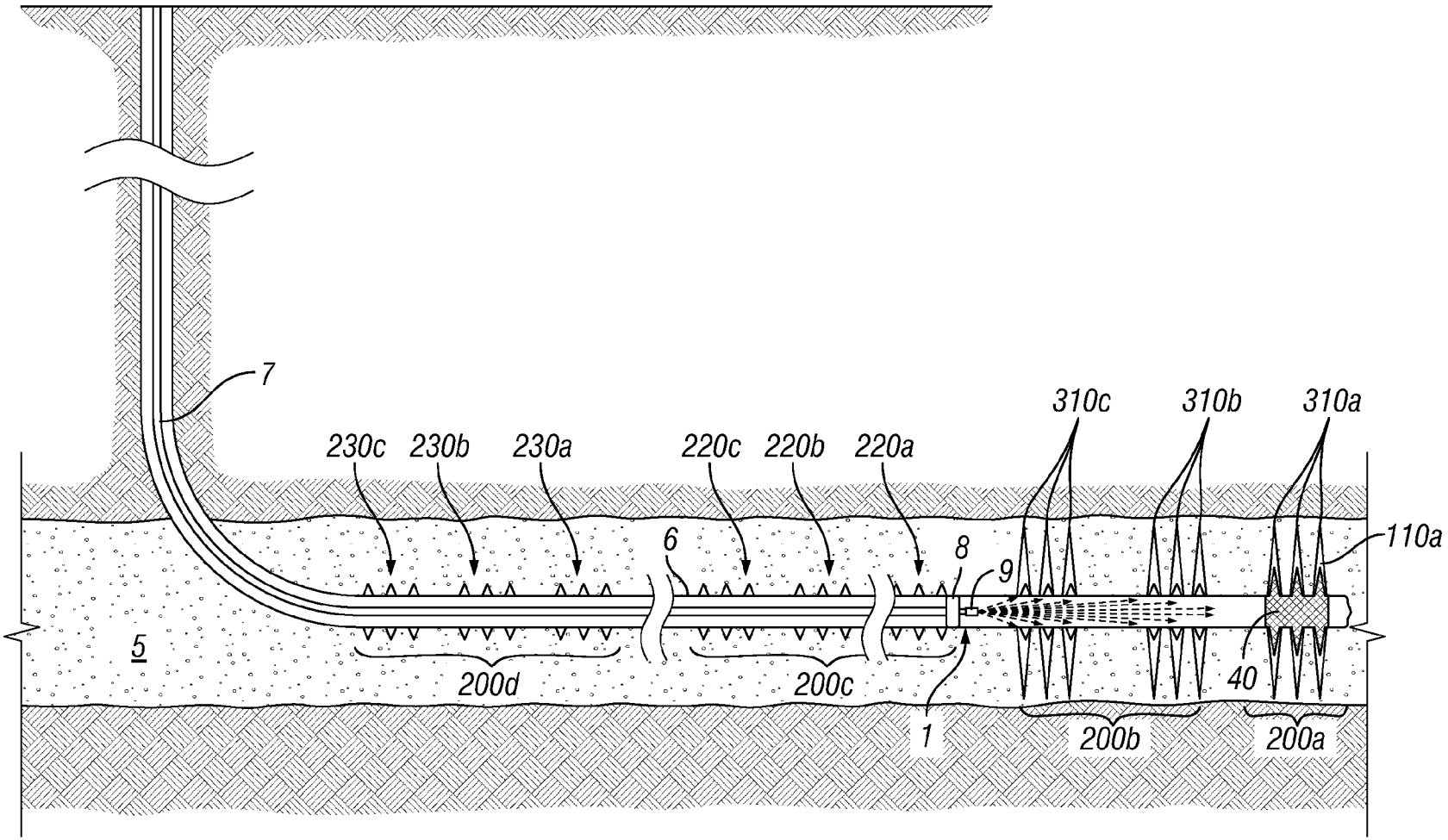
FIG. 13 shows re-fracturing a location of a multizone horizontal wellbore.

FIG. 13 shows the re-fracturing of a wellbore location 200*b*, which includes two fracture clusters 310*b* and 310*c* that have been previously fractured. Prior to re-fracturing location 200*b*, location 200*a*, which includes fracture cluster 310*a*, has been re-fractured. A plug 40 has been formed within the wellbore 1 to isolate location 200*a* during the re-fracturing of location 200*b*. After re-fracturing location 200*b*, a plug 40 may be positioned above location 200*b* and the packer 8 may be located above location 200*c* to permit the re-fracturing of location 200*c*, Location 200*c* may include a plurality of fracture clusters such as 220*a*, 220*b*, and 220*c*, as shown in FIG. 13. After re-fracturing location 200*c*, the location 200*c* may be hydraulically isolated and the packer 8 may be positioned above the next location 200*d* that is to be re-fractured. The next location 200*d* may include a single fracture cluster or a plurality of fracture clusters 230*a*, 230*b*, and 230*c*, as shown in FIG. 13. After re-fracturing a location, such as location 200*b*, a location, such as location 200*c*, may be isolated from being re-fractured if it is determined that the location should be not be re-fractured as discussed above.

Although this invention has been described in terms of certain preferred embodiments, other embodiments that are apparent to those of ordinary skill in the art, including embodiments that do not provide all of the features and advantages set forth herein, are also within the scope of this invention. Accordingly, the scope of the present invention is defined only by reference to the appended claims and equivalents thereof.

What is claimed is:

1. A method for re-fracturing a location of a formation of a multizone horizontal wellbore, the method comprising:

hydraulically isolating a first location from a portion of the multizone horizontal wellbore uphole from the first location, the first location having been previously hydraulically fractured at least once;

hydraulically re-fracturing the first location;

providing a first plug within the wellbore proximate to the first location after the first location has been hydraulically re-fractured;

pumping fluid down the wellbore to bridge off the first plug within the wellbore to hydraulically isolate the re-fractured first location from the multizone horizontal wellbore uphole of the first location, wherein the first plug comprises proppant combined with crystalline silica hydraulically isolating a second location from a portion of the multizone horizontal wellbore uphole of the second location;

hydraulically fracturing the second location;

providing a second plug within the wellbore proximate to the second location after the second location has been fractured; and pumping fluid down the wellbore to bridge off the second plug within the wellbore to hydraulically isolate the second location from a portion of the multizone horizontal wellbore uphole of the second location, wherein the second plug comprises proppant combined with crystalline silica.

2. The method of claim 1, wherein the second location having been previously hydraulically fractured at least once and wherein hydraulically fracturing the second location further comprises hydraulically re-fracturing the second location.

3. The method of claim 1, wherein the proppant comprises ultra-lightweight proppant.

4. The method of claim 1, wherein the first location is a fracture cluster farthest downhole of the multizone horizontal wellbore and wherein hydraulically isolating the first location further comprises creating a seal with a packing element connected to a coiled tubing string to seal an annulus between the coiled tubing string and a casing of the multizone horizontal wellbore uphole of the first location.

5. The method of claim 1, further comprising cleaning out at least a portion of the multizone horizontal wellbore after re-fracturing the first location and fracturing the second location to remove the first and second plugs from the multizone horizontal wellbore.

6. The method of claim 5, further comprising producing hydrocarbons from the first and second locations of the multizone horizontal wellbore.

7. The method of claim 1, wherein there is at least one fracture cluster positioned between the first location and the second location and hydraulically isolating the second location further comprises providing a third plug within the wellbore comprised of proppant combined with crystalline silica between the first and second locations and creating a seal with a packing element connected to a coiled tubing string to seal an annulus between the coiled tubing string and a casing of the multizone horizontal wellbore uphole from the second location, wherein the third plug is provided within the wellbore prior to creating the seal uphole from the second location and further comprises pumping fluid down the wellbore to bridge off the third plug within the wellbore prior to creating the seal uphole from the second location.

8. A system for re-fracturing a plurality of locations within a multizone horizontal wellbore, the system comprising:

a first tubing string positioned within a multizone horizontal wellbore, the first tubing string extending from a surface location to a first location in the multizone horizontal wellbore, the first location being a lowermost previously fractured location along the multizone horizontal wellbore;

a packing element connected proximate to an end of the first tubing string, the packing element adapted to repeatedly seal an annulus between the first tubing string and a casing of the multizone horizontal wellbore, the end of the first tubing string being adapted to permit the hydraulic re-fracturing of selected locations within the multizone horizontal wellbore; and a plurality of plugs comprised of proppant and polymer, each of the plurality of plugs positioned within the casing and proximate to a previously fractured location to selectively hydraulically isolate the previously fractured location, wherein the polymer comprises crystalline silica.

9. The system of claim 8, wherein the first tubing string comprises a coiled tubing string.

10. The system of claim 8, wherein the proppant comprises ultra-lightweight proppant.

11. A method for selectively fracturing one or more locations within a horizontal wellbore, the method comprising:

positioning a packing element uphole of a first location, the packing element being connected to a tubing string;

actuating the packing element to seal an annulus between the tubing string and a casing uphole of the first location;

pumping fluid down the tubing string to fracture the first location;

providing a first plug within the casing comprised of proppant and polymer proximate the first location;

pumping fluid down the horizontal wellbore to bridge off the first plug within the casing to hydraulically isolate the first location, wherein the polymer of the first plug comprises crystalline silica;

unsetting the packing element;

positioning the packing element uphole of a second location;

actuating the packing element to seal the annulus between the tubing string and the casing uphole of the second location;

pumping fluid down the tubing string to fracture the second location;

providing a second plug within the casing comprised of proppant and polymer proximate the second location; and pumping fluid down the horizontal wellbore to bridge off the second plug within the casing to hydraulically isolate the second location, wherein the polymer of the second plug comprises crystalline silica.

12. The method of claim 11, wherein the first and second locations were previously fractured and pumping fluid down the tubing string further comprises re-fracturing the first and second locations.

13. The method of claim 12, further comprising removing the first and second plugs and producing hydrocarbons from the pre-fractured first and second previously fractured locations.

* * * * *